United States Patent [19]

Okamoto et al.

[11] Patent Number: 4,655,904

[45] Date of Patent: Apr. 7, 1987

[54] THERMAL CRACKING PROCESS FOR SELECTIVELY PRODUCING OLEFINS AND AROMATIC HYDROCARBONS FROM HYDROCARBONS

[75] Inventors: Toshiro Okamoto, Tokyo; Michio Ohshima, Hiroshima, both of Japan

[73] Assignee: Mitsubishi Jukogyo Kabushiki Kaisha, Tokyo, Japan

[21] Appl. No.: 621,428

[22] Filed: Jun. 18, 1984

[30] Foreign Application Priority Data

Jun. 17, 1983 [JP] Japan ..... 58-109059

[51] Int. Cl.[4] ..... C10G 9/38

[52] U.S. Cl. ..... 208/129; 208/72; 208/75; 208/106; 208/130; 585/648; 585/652

[58] Field of Search ..... 208/130, 72, 75, 106; 585/374, 648, 652, 650

[56] References Cited

U.S. PATENT DOCUMENTS

| | | | |
|---|---|---|---|
| 2,870,231 | 1/1959 | Hughes et al. | 585/652 |
| 3,170,863 | 2/1965 | Spillane et al. | 585/652 |
| 3,419,632 | 12/1968 | Torusogawa et al. | 585/652 |
| 3,579,438 | 5/1971 | Cruse | 208/130 |
| 3,579,601 | 5/1971 | Kivlen | 208/130 |
| 3,705,926 | 12/1972 | Rumpf et al. | 585/648 |
| 3,718,709 | 2/1973 | Simoneta | 585/652 |
| 3,855,339 | 12/1974 | Hosoi et al. | 585/648 |
| 4,134,824 | 1/1979 | Kamm | 585/652 |
| 4,166,830 | 9/1979 | Guth et al. | 585/650 |
| 4,321,131 | 3/1982 | Lowe | 585/648 |
| 4,361,478 | 11/1982 | Gengler et al. | 208/130 |
| 4,479,869 | 10/1984 | Petterson et al. | 585/648 |
| 4,527,002 | 7/1985 | Kamisaka et al. | 208/107 |
| 4,527,003 | 7/1985 | Okamoto et al. | 208/107 |
| 4,587,011 | 5/1986 | Okamoto et al. | 208/130 |

*Primary Examiner*—Andrew H. Metz
*Assistant Examiner*—Anthony McFarlane
*Attorney, Agent, or Firm*—Toren, McGeady and Goldberg

[57] ABSTRACT

A process for selectively producing olefins and aromatic hydrocarbons by thermal cracking of hydrocarbons which comprises the steps of: burning hydrocarbons with oxygen in the presence of steam to produce a hot gas of from 1300° to 3000° C. comprising steam; feeding a heavy hydrocarbon to the hot gas to thermally crack the heavy hydrocarbon under conditions of a temperature not lower than 1000° C., a pressure not higher than 100 kg/cm$^2$g, and a residence time of from 5 to 20 milliseconds; further feeding a light hydrocarbon downstream of the feed of the heavy hydrocarbon in such a way that a light hydrocarbon with a lower boiling point is fed at a lower temperature side downstream of the feed of the heavy hydrocarbon, thereby thermally cracking the light hydrocarbon under conditions of a reactor outlet temperature at not lower than 650° C., a pressure at not higher than 100 kg/cm$^2$g, and a residence time at 5 to 1000 milliseconds; and quenching the resulting reaction product.

5 Claims, 1 Drawing Figure

THERMAL CRACKING PROCESS FOR SELECTIVELY PRODUCING OLEFINS AND AROMATIC HYDROCARBONS FROM HYDROCARBONS

BACKGROUND OF THE INVENTION

1. Field of the Invention

This invention relates to a process for selectively producing olefins and aromatic hydrocarbons (hereinafter abbreviated as BTX) by thermal cracking of hydrocarbons. More particularly, it relates to a process for producing olefins and BTX in high yield and high selectivity which comprises the steps of burning hydrocarbons with oxygen in the presence of steam to generate a hot gas comprising steam, and feeding, to the hot gas comprising steam and serving as a heat source for thermal cracking, different types of hydrocarbons from feeding positions enabling the respective hydrocarbons to be thermally cracked under optimum cracking conditions in view of their cracking characteristics.

2. Description of the Prior Art

As is well known, the tubular-type thermal cracking process called steam cracking has heretofore been used to convert, into olefins, light gaseous hydrocarbons such as ethane and propane as well as liquid hydrocarbons such as naphtha and kerosine. According to this process, heat is supplied from outside through tube walls, thus placing limits on the heat per rate speed and the reaction temperature. Ordinary conditions adopted for the process include a temperature below 850° C. and a residence time ranging from 0.1 to 0.5 second. Another process has been proposed in which use is made of small-diameter tubes so that the cracking severity is increased in order to effect the cracking within a short residence time. In this process, however, because of the small inner diameter, the effective inner diameter is reduced within a short time owing to coking on the inner walls. As a consequence, the pressure loss in the reaction tube increases with an increasing partial pressure of hydrocarbons, thus worsening the selectivity to ethylene. This, in turn, requires short time intervals of decoking, leading to the vital disadvantage that because of the lowering in working ratio of the cracking furnace and the increase of heat cycle due to the decoking, the apparatus is apt to damage. In the event that the super high temperature and short time cracking would become possible, it would be difficult to stop the reaction, by quenching, within a short time corresponding to the cracking severity. This would result in the fact that the selectivity to ethylene which has once been established in a reactor unit considerably lowers by shortage of the quenching capability of a quencher. In view of these limitations on the apparatus and reaction conditions, starting materials usable in the process will, at most, cover gas oils. Application to heavy hydrocarbons such as residues, cannot be expected. This is because high temperature and long time reactions involve side reactions of polycondensation with coking occurring vigorously and a desired gasification rate (ratio by weight of a value obtained by subtracting an amount of $C_5$ and heavier hydrocarbons except for BTX from an amount of hydrocarbons fed to a reaction zone, to an amount of starting hydrocarbon feed) cannot be achieved. Consequently, the yield of useful components lowers. Once a starting material is selected, specific cracking conditions and a specific type of apparatus are essentially required for the single starting material and a product derived therefrom. This is disadvantageously unadaptable to the type of starting material and the selectivity to product.

For instance, a currently used, typical tubular-type cracking furnace has the central aim in the production of ethylene. Thus, it is difficult to arbitrarily vary yields of other by-products such as propylene, $C_4$ fractions and BTX in accordance with a demand and supply balance. This means that since it is intended to secure the production of ethylene from naphtha as will otherwise be achieved in high yield by high severity cracking of other substitute materials, great potentialities of naphtha itself for formation of propylene, $C_4$ fractions such as butadiene, and BTX products are sacrificed. The thermal cracking reaction has usually such a balance sheet that an increase in yield of ethylene results in an inevitable reduction in yield of propylene and $C_4$ fractions.

Seveal processes have been proposed in order to mitigate the limitations on both starting materials and products. In one such process, liquid hydrocarbons such as petroleum are burnt to give a hot gas. The hot gas is used to thermally crack hydrocarbons under a pressure of from 5 to 70 bars at a reaction temperature of from 1,315° to 1,375° C. for a residence time of from 3 to 10 milliseconds. In the process, an inert gas such as $CO_2$ or $N_2$ is fed in the form of a film from the buring zone of the hot gas toward the reaction zone so as to suppress coking and make it possible to crack heavy oils such as residual oils.

Another process comprises the steps of partially burning hydrogen to give hot hydrogen gas, and thermally cracking various hydrocarbons such as heavy oils an atmosphere of hydrogen under conditions of a reaction temperature of from 800° to 1800° C., a residence time of from 1 to 10 milliseconds and a pressure of from 7 to 70 bars thereby producing olefins. The thermal cracking in an atmosphere of great excess hydrogen enables one to heat hydrocarbons rapidly and crack within a super-short residence time. Likewise, suppression of coking enables one to effect cracking of heavy oils. However, power consumptions for recycle and separation of hydrogen, make-up, and energy for preheating place an excessive economical burden on the process.

All the processes require very severe reaction conditions in order to obtain olefins in high yields from heavy hydrocarbons. As a result, olefinic products obtained are predominantly composed of $C_2$ products such as ethylene, acetylene and the like, with an attendant problem that it is difficult to obtain propylene, $C_4$ fractions, and BTX at the same time in high yields.

A further process comprises separating a reactor into two sections, feeding a paraffinic hydrocarbon of a relatively small molecular weight to an upstream, high temperature side so that it is thermally cracked at a relativey high severity (e.g. a cracking temperature exceeding 815° C., a residence time of from 20 to 150 milliseconds), thereby improving the selectivity to ethylene, and feeding gas oil fractions to a downstream, low temperature side so as to thermally crack them at a low severity for a long residence time, e.g. a cracking temperature below 815° C. and a residence time of from 150 to 2,000 milliseconds whereby coking is suppressed. Instead, the gasification rate is sacrificed. Similar to the high temperature side, the purposes at the low temperature side are to improve the selectivity to ethylene.

In the above process, the starting materials are so selected as to improve the selectivity to ethylene: paraffinic materials which are relatively easy for cracking are fed to the high temperature zone and starting materials abundant with aromatic materials which are relatively difficult to crack are fed to the low temperature zone.

However, starting materials containing aromatic components are cracked in the low temperature reaction zone at a low severity, so that components which can be evaluated as valuable products when gasified are utilized only as fuel. Thus, this process is designed to place limitations on the types of starting materials and products, thus presenting the problem that free selection of starting materials and production of intended products are not possible.

We have made intensive studies to develop a thermal cracking process of hydrocarbons to selectively obtain desired types of olefins and BTX in high yields from a wide variety of hydrocarbons ranging from light to heavy hydrocarbons in one reactor while suppressing the coking. As a result, it has been found that thermal cracking of hydrocarbons effectively proceeds by a procedure which comprises the steps of burning hydrocarbons with oxygen in the presence of steam to produce a hot gas stream containing steam, feeding arbitrary starting materials to different cracking positions in consideration of the selectivity to desired products and the characteristics of the starting hydrocarbons. By the thermal cracking, a variety of hydrocarbons ranging from gas oils such as light gas and naphtha to heavy oils such as asphalt can be treated simultaneously in one reactor. Moreover, olefins and BTX can be produced in higher yields and higher selectivity than in the case where individual hydrocarbons are thermally cracked singly as in a conventional manner. The present invention is accomplished based on the above finding.

SUMMARY OF THE INVENTION

It is accordingly an object of the invention to provide a thermal cracking process for producing olefins and BTX in high yield and high selectivity in one reactor while suppressing coking.

It is another object of the invention to provide a thermally cracking process in which olefins and BTX are obtained from a wide variety of starting hydrocarbons including light and heavy hydrocarbons by cracking different types of starting hydrocarbons under different cracking conditions.

The above objects can be achieved, according to the invention, by a thermal cracking process for selectively producing olefins and aromatic hydrocarbons from hydrocarbons, the process comprising the steps of: (a) burning hydrocarbons with oxygen in the presence of steam to produce a hot gas of 1,300° to 3,000° C. comprising steam, (b) feeding to the hot gas a starting heavy hydrocarbon comprising hydrocarbon components having boiling points not lower than 350° C. to thermally crack the heavy hydrocarbon under conditions of a temperature at not lower than 1,000° C., a pressure at not higher than 100 kg/cm$^2$ g, and a residence time at 5 to 20 milliseconds, (c) further feeding a light hydrocarbon comprising hydrocarbon components having boiling points not higher than 350° C. downstream of the first feed in such way that a hydrocarbon of a lower boiling point is fed at a lower temperature side in the downstream zone, thereby thermally cracking the light hydrocarbon under conditions of a reactor outlet temperature at not lower than 650° C., a pressure at not higher than 100 kg/cm$^2$ g, and a residence time at 5 to 1000 milliseconds, and quenching the reaction product.

BRIEF DESCRIPTION OF THE DRAWINGS

The sole FIGURE is a flowchart of a process according to the invention.

DETAILED DESCRIPTION AND EMBODIMENTS OF THE INVENTION

Figure 1:
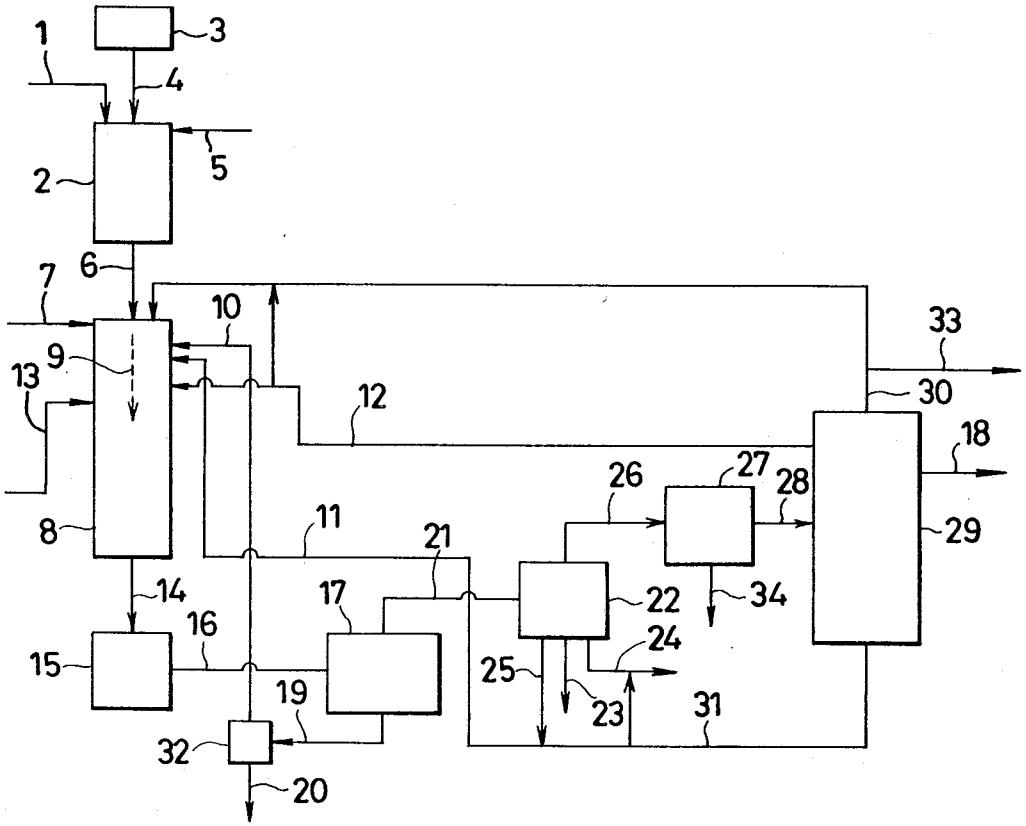

According to the present invention, heat energy required for the reactions is supplied from a hot gas comprising steam which is obtained by burning hydrocarbons with oxygen in the presence of steam. The heat is supplied by internal combustion and such high temperatures as will not be achieved by external heating are readily obtained with the heat generated being utilized without a loss. The heating by the internal combustion of hydrocarbons has been heretofore proposed. In general, gaseous hydrocarbons and clean oils such as kerosine are mainly used for these purposes. Use of heavy oils has also been proposed. However, burning of these oils will cause coking and sooting, which requires circulation of an inert gas such $CO_2$, $N_2$ or the like in large amounts as described before.

In the practice of the invention, burning is effected in the presence of steam, including such steam as required in the downstream or subsequent reaction zone, in amounts of 1 to 20 (by weight) times as large as an amount of a fuel hydrocarbon. By this, coking and sooting can be suppressed by mitigation of the burning conditions and the effect of reforming solid carbon with steam. Accordingly, arbitrary hydrocarbons ranging from light hydrocarbons such as light gas and naphtha to heavy hydrocarbons such as cracked distillates and asphalt may be used as the fuel. Alternatively, hydrogen and carbon monoxide may also be used as the fuel.

The amount of oxygen necessary for the burning may be either below or over the theoretical. However, if the amount of oxygen is excessive, effective components are unfavorably lost in a reaction zone at a downstream position. On the other hand, when the amount of oxygen is less than the theoretical, it is advantageous in that hydrogen which is relatively deficient in heavy hydrocarbons is made up at the time of combustion of hydrocarbons, thus increasing a gasification rate and a yield of olefins while suppressing coking. In some cases, the partial oxidation of the fuel may be advantageous because synthetic gas useful for the manufacture of methanol is obtained as a byproduct.

Different from $CO_2$, $N_2$ and other gases, steam added to the reaction system is readily condensed in a separation and purification procedure of the cracked gas and is thus recovered, with an advantage that little or no additional burden the purification system is imposed. Oxygen used in the process of the invention is usually enriched oxygen which is obtained from air by low temperature gas separation, membrane separation or adsorption separation. If air is effectively used by combination with, for example, an ammonia production plant, such air may be used.

The combustion gas from a burner is raised to or maintained at high temperatures while reducing the feed of steam from outside and is fed to a reactor. This is advantageous from the standpoint of heat balance. However, when the combustion gas exceeds 2400° C. a concentration of oxygen-containing radicals such as O, OH and the like increases, so that valuable products are lost considerably in a downstream reaction zone with an increase of acetylene, CO and the like in amounts. This makes it difficult to uniformly heat starting materials. In view of the stability of the burner construction, the upper limit of the gas temperature exists.

To the hot gas of 1300° to 3000° C. comprising steam which is produced by the burner is fed a heavy hydrocarbon comprising hydrocarbon components whose boiling points are not lower than 350° C. The heavy hydrocarbon is thermally cracked under high temperature and short residence time conditions of the inlet temperature of the reactor at over 1,000° C., the pressure at not higher than 100 kg/cm$^2$ g, and the residence time at 5 to 20 milliseconds. In the thermal cracking of such a heavy hydrocarbon comprising hydrocarbon components having boiling points over 350° C. inclusive, it is important that the starting hydrocarbon be rapidly heated, vaporized and gasified, and cracked in the gas phase diluted with the steam into low molecular weight olefins such a ethylene, propylene, butadiene and the like. As a result, a high gasification rate is achieved and olefins and BTX are produced in high yields. In contrast, if a satisfactory high heating rate is not attained, polycondensation in liquid phase takes palce, with the results that the gasification rate and the olefin and BTX yields become very unsatisfactory. In the practice of the invention, a hot gas of from 1,300° to 3,000° C., preferably from 1,400° to 2,400° C., comprising steam is formed. This hot gas is directly contacted with starting hydrocarbons so as to raise the hydrocarbons to a temperature beyond 1,000° C. This direct contact enables one to thermally crack the heavy hydrocarbon by rapid heating as required.

Starting materials having higher boiling points and higher contents of polycyclic aromatic components such as asphaltene which are difficult to crack should be fed to a higher temperature zone. In order to achieve a high gasification rate (e.g. over 70%), the heavy hydrocarbon has to be thermally cracked at a high severity. It is inevitable that ethylene be high in yield among olefinic products. The thermal cracking of heavy hydrocarbons is an endothermic reaction. The temperature of the reaction fluid after the thermal cracking slightly lowers but is still maintained at high level.

The above temperature level is sufficient to readily crack at least light hydrocarbons of low boiling points. In the practice of the invention, the reaction fluid after the thermal cracking of the heavy hydrocarbon is subsequently used. To the fluid are added relatively light hydrocarbons containing hydrocarbon components whose boiling points are below 350° C. in such a way that they are thermally cracked under proper control of the range of boiling point (the types of hydrocarbons such as naphtha fractions, kerosine fraction and the like), the amount and/or thermally cracking conditions. This control makes it possible to arbitrarily change a composition or distribution in yield of olefins and BTX in final product. In other words, good selectivity to a desired product can be achieved. This is one of prominent features of the present invention.

The thermal cracking conditions are suitably controlled by changing the feed position of starting material, total pressure, residence time and temperature. In order to optimize cracking conditions of the respective starting hydrocarbons from the standpoint of the flexibility in starting hydrocarbons and products therefrom and also to suppress coking during the course of the feed of the starting hydrocarbons, steam, water, hydrogen, methane, hydrogen sulfide and the like may be fed at a position between feed positions of the starting hydrocarbons or simultaneously with the charge of starting hydrocarbons. As mentioned, this is advantageous in suppressing coking. A similar procedure may be taken in order to offset the disadvantage produced by a partial load operation.

The heavy hydrocarbons containing hydrocarbon components with boiling points not lower than 350° C. include, for example, hard-to-crack oils containing polycyclic aromatic compounds such as asphaltene, e.g. topped crude, vacuum residue, heavy oil, shale oil, orinoco tar, coal liquefied oil, cracked oil, and cracked residue; substantially free of asphaltene but containing large amounts of resins and aromatic compounds, e.g. vacuum gas oils, solvent-deasphalted oils, and the like heavy crude oil; and coal. The light hydrocarbons containing hydrocarbon components whose boiling points not higher than 350° C. include, for example, cracked oils and reformed oils such as LPG, light naphtha, naphtha, kerosine, gas oil, cracked gasoline (having $C_5$ and higher fractions up to 200° C. but removing BTX therefrom). As will be described hereinafter, light paraffin gases such as methane, ethane, propane and the like are different in cracking mechanism and are thermally cracked under different operating conditions.

The above classification depending on the boiling point or cracking characteristics is merely described as a basic principle. For instance, even though starting hydrocarbons contain such hydrocarbons having boiling points not lower than 350° C., those hydrocarbons such as light crude oil which contain large amounts of light fractions, abound in paraffinic components relatively easy in cracking, and have a small amount of asphaltene are classified as light hydrocarbons. Likewise, starting hydrocarbons which contain hydrocarbon components having boiling points over 350° C. but consist predominantly of hydrocarbons having substantially such a cracking characteristic as of hydrocarbons whose boiling point is below 350° C., are classified as light hydrocarbons whose boiling point is below 350° C.

If fuel oil is essential in view of the fuel balance in the system or other specific conditions exist, even hydrocarbons having boiling points over 350° C. may be thermally cracked under conditions similar to those for light hydrocarbons whose boiling point is below 350° C. in order to intentionally suppress the gasification rate.

In the event that a starting hydrocarbon contains hydrocarbons whose boiling point is below 350° C. but relatively large amounts of hard-to-crack components such as resins, cracking conditions for heavy hydrocarbons may be adopted in view of the requirement for selectivity to a desired product.

In practice, similar types of starting materials which have slight different boiling points are fed from the same position under which same cracking conditions are applied. As the case may be, starting materials of the same cracking characteristics may be thermally cracked under different conditions in order to satisfy limitations on the starting materials and requirements for final product.

As a principle, it is favorable that a hydrocarbon is thermally cracked under optimum cracking conditions which are determined on the basis of the cracking characteristics thereof. However, in view of limitations of starting hydrocarbons and requirements in composition of a final product, optimum cracking conditions may not always be applied. In accordance with the process of the invention, starting hydrocarbons are fed to a multistage reactor and can thus satisfy the above requirements without any difficulty.

The cracking characteristics of starting hydrocarbons are chiefly judged from the boiling point thereof. More particularly and, in fact, preferably, the feed position and cracking conditions should be determined in view of contents of paraffins, aromatic compounds, asphaltene and the like substances in the individual starting hydrocarbons.

Needless to say, even though a hydrocarbon containing components whose boiling points are not lower than 350° C. is not utilized a a starting hydrocarbon, naphtha may be thermally cracked under high temperature and short residence time conditions as described with reference to heavy hydrocarbons in order to carry out the thermal cracking at high selectivity to ethylene. In a subsequent or downstream reaction zone, naphtha, propane or the like is fed and cracked under mild conditions so that selectivities to propylene, $C_4$ fractions and BTX are increased. Thus, when the system is taken into account as a whole, a desired composition of the product can be arbitrarily achieved.

A further feature of the invention resides in that the light paraffin gas and cracked oil produced by the thermal cracking are fed to a position of the reactor which is determined according to the cracking characteristics thereof so as to increase a gasification rate to a high level (e.g. 60% or more with asphalt and 90% or more with naphtha). The recycling of such a cracked oil to the same reactor has been proposed in some instances, in which the cracked oil is merely fed to the same position and cracked under the same conditions as starting hydrocarbons. Little contribution to an improvement of yield can be expected. This is because when a cracked oil is fed at the same position as a fresh starting material, the starting material which is more likely to crack is preferentially cracked. The cracked oil merely suffers a heat history and is converted to heavy hydrocarbons by polycondensation reaction. In contrast, according to the invention, the cracked oil is fed to a higher temperature zone than the position where the initial starting hydrocarbon has been fed, by which the cracked oil is further cracked under a higher severity than the initial starting hydrocarbon from which the cracked oil is produced. In this manner, the cracked oil is recycled to the reactor and utilized as a starting material.

The fed position of the cracked oil is determined depending on the cracking characteristics and the desired composition of a final product. Especially, in order to increase selectivities to products of propylene, $C_4$ components and BTX, relatively mild cracking conditions of light hydrocarbons are used in the downstream reaction zone. As a consequence, the yield of the cracked oil increases while lowering a gasification rate. When this cracked oil is fed to a higher temperature zone upstream of the feed position of the initial starting hydrocarbon from which the cracked oil is mainly produced, it is readily cracked and converted into ethylene, BTX and the like. As a whole, the gasification rate and the toal yield of useful components increase. At the same time, high selectivity to a desired product is ensured.

In known naphtha cracking processes, 15 to 20% of cracked oil (exclusive of BTX) is produced. In the practice of the invention, 50 to 60% of the cracked oil used as fuel is recovered as useful components (ethylene, BTX and the like).

Light paraffinic gases such as ethane, propane and the like are fed to a reaction zone at a temperature from 850° to 1,000° C. and cracked to obtain ethylene, propylene and the like. These gases serving also as a hydrogen carrier gas may be fed to a position upstream of the feed position of the heavy hydrocarbon.

On the other hand, hydrogen and methane may be withdrawn as a product gas, or may be fed to a position same as or upstream of the feed position of a heavy hydrocarbon predominantly composed of hydrocarbon components having boiling points not lower than 350° C. in order to supplement hydrogen deficient in the heavy hydrocarbon and convert to useful components.

Moreover, when a light hydrocarbon such as naphtha having a high content of hydrogen is fed to a downstream position, a partial pressure of hydrogen increases at the position. As a result, the radicals produced by the cracking of a heavy hydrocarbon in the upstream zone are hydrogenated an thus stabilized. Thus, formation of sludge, and coking in the reactor and quenching heat exchanger are suppressed with the thermally cracked residue being stabilized. However, the stabilization of the thermally cracked residue only by the action of the hydrogen may be unsatisfactory depending on the type of starting hydrocarbon and the cracking conditions. In such case, the residue may be separately treated with hydrogen, or may be stabilized by recycling of hydrogen or methane from the product separation and purification system.

A carbonaceous cracked residue which is produced by cracking of a heavy hydrocarbon under a super severity was, in some case, hard to handle (or transport) for use as a starting material or fuel or to atomize in burners. The problems of the handling and the atomization in burners are readily solved, according to the invention, by mixing a cracked oil obtained by mild cracking of a light hydrocarbon in a downstream, low temperature side and a carbonaceous cracked residue obtained by thermal cracking at an upstream, high temperature side. The cracked oil from the light hydrocarbon abounds in volatile matters and hydrogen-donating substances, so that the solid cracked residue is stably converted to a slurry by mixing with the oil. In addition, an increase of the volatile matters makes it easier to boil and spray the mixture in burners, thus facilitating atomization. Accordingly, effective components in the cracked residue may be re-utilized as a starting material.

Further advantages and features of the present invention are described below.

As described before, the feed of a light hydrocarbon comprising hydrocarbon components which have low boiling points below 350° C. and are more likely to crack contributes to more effectively recover heat energy remained still after the thermal cracking of a heavier hydrocarbon by absorption of heat required for the reaction of the light hydrocarbon. Because the reaction fluid, from the high temperature, upstream side, comprising a cracked gas from the heavy hydrocarbon is rapidly cooled by the endothermic reaction of the light hydrocarbon, a loss of valuable products by excessive cracking can be avoided.

In the practice of the invention, thermal cracking of hydrocarbons is effected by making use of the heat energy supplied for the cracking to a maximum, and thus a amount of combustion gas per unit amount of product can be markedly reduced, with the advantage that the the power consumption required for separation and purification can be much more reduced than in known similar techniques. In other words, the utility including fuel, oxygen and the like per unit product condiserably lowers.

Once again, the present invention is characterized in that light and heavy hydrocarbons having significant differences in cracking characteristics are, respectively, cracked under optimum conditions required for the cracking characteristics in view of the desired type of product. High boiling heavy hydrocarbons such as topped crude, vacuum residue and the like undergo polycondensation reaction in liquid phase competitively with the formation reaction of olefins. In order to increase the gasification rate and the yield of olefins, it is necessary to shorten the residence time in liquid phase as short as possible. In this sense, it is very important to effect the cracking by heating at high temperatures within a super short time. However, when cracked at such high temperatures, once formed propylene and $C_4$ components will be further cracked irrespective of the super short time cracking, thereby giving ethylene. Thus, a content of ethylene in the final product becomes very high. If it is intended to increase selectivities to propylene and $C_4$ components, the gasification rate lowers. Although propylene and $C_4$ components slightly increase in amounts, the yield of ethylene lowers considerably. Judging from the above, heavy hydrocarbons should preferably be cracked under conditions which permit an enhanced selectivity to ethylene.

On the other hand, light hydrocarbons such as naphtha are readily gasified, and either polycondensation of acetylene, ethylene or butadiene in gas phase or cyclization dehydrogenation reaction of starting paraffins gives BTX and cracked oil. As compared with heavy hydrocarbons, the influence of the heating velocity is smaller and a relatively wider range of reaction conditions may be used. For instance, high temperature cracking permits predominant formation of lower olefins by cracking of the paraffin chains. The yield of BTX and cracked oil by the cyclization dehydrogenation reaction lowers. Formation of BTX by polycondensation of lower olefins and acetylene in gas phase increases with an increase of the residence time. For short residence time, the yield of BTX lowers. At a higher severity (i.e. high temperature and long residence time conditions), ethylene is produced in high amounts by cracking. Thus, the ratio of propylene and $C_4$ fractions to total lower olefins lowers, with an increasing selectivity to ethylene. With light hydrocarbons, a high gasification rate is obtained by cracking even at low temperatures as is different from the case of heavy hydrocarbons. In addition, the product comprises an increasing ratio of propylene and $C_4$ fractions with less valuable methane being reduced in amounts. The total yield of olefins including $C_2$ to $C_4$ increases to the contrary.

In the cracking at low temperatures, the relative yield of BTX and cracked oil produced by the cyclization dehydrogenation reaction increases. The increase in yield of the cracked oil may bring about a lowering of the gasification rate. In the practice of the invention, the cracked oil is fed to a position of higher temperatures than as required for the formation of the cracked oil and are thus converted to ethylene, BTX and the like. As a whole, the gasification rate, yield of useful components and selectivity can be improved over ordinary cases of single stage cracking at high temperatures.

In the process of the invention, light hydrocarbons and heavy hydrocarbons having different cracking characteristics are cracked under different conditions: a heavy hydrocarbon is cracked under high temperature and high severity conditions so as to attain a high gasification and a high yield of olefins (mainly composed of ethylene). Subsequently, a light hydrocarbon is cracked under low temperature and long residence time conditions in order to achieve high selectivity to $C_3$ and $C_4$ olefins and BTX, thereby preparing a controlled composition of product. The cracking conditions under which high selectivity to $C_3$ and $C_4$ olefins and BTX is achieved are relatively low temperature conditions as described before. The excess of heat energy which is thrown into the reactor for thermal cracking of heavy hydrocarbons is effectively utilized for the low temperature cracking. Moreover, the cracked oil produced by cracking of a starting hydrocarbon is further cracked under higher temperature conditions than as with the case of the starting hydrocarbon, by which the component which has been hitherto evaluated only as fuel can be converted into valuable BTX components and ethylene. For instance, condensed aromatic ring-bearing substances such as anthracene are cracked at high temperatures for conversion into highly valuable components such as methane, ethylene, BTX and the like. The conversion is more pronounced at a higher partial pressure of hydrogen.

In the practice of the invention, in order to effectively utilize starting hydrocarbons, the starting hydrocarbons are fed to different positions of a multi-stage reactor depending on the cracking characteristics. In the high temperature zone, cracking under high severity conditions is effected to achieve a high gasification and a high yield of ethylene. In a subsequent zone, a hydrocarbon is cracked so that high selectivity to $C_3$ and $C_4$ fractions and BTX is achieved. Thus, there are prepared the cracked gas which is obtained under high severity cracking conditions in the high temperature zone and is predominantly made of ethylene, and the cracked gas obtained in the low temperature zone and having high contents of $C_3$ and $C_4$ olefins and BTX, making it possible to selectively produce a product of a desired composition.

As described before, it is not necessarily required that a heavy hydrocarbon having a boiling point not lower than 350° C. is used as a starting virgin material. For instance, naphtha or kerosine may be cracked at high temperatures in the upstream zone, thereby giving a cracked gas enriched with ethylene. In the downstream zone, hydrocarbons which have the high potentiality of conversion into $C_3$ and $C_4$ olefins such as LPG, naphtha and the like, and BTX are thermally cracked under conditions permitting high selectivity to the $C_3$, $C_4$ olefins and BTX, thereby obtaining a controlled composition.

According to the present invention, one starting material such as naphtha may be divided into halves which are, respectively, subjected to the high temperature and low temperature crackings. Alternatively, virgin naphtha may be wholly cracked at low temperatures, followed by subjecting the resulting cracked oil to the high temperature cracking so as to meet the purposes of the invention. On the contrary, to crack at high temperatures and then at low temperatures heavy hydrocarbons such as vacuum gas oil made of components with boiling points over 350° C. and having high selectivity of $C_3$, $C_4$ olefins and BTX is within the scope of the present invention. The manner of application as described above may be suitably determined depending on the availability of starting hydrocarbon and the composition of final product based on the trend of demand of supply.

Cracking of heavy hydrocarbons involved the problem that in order to attain a high gasification rate, high temperatures or high heat energy is needed and that a composition of product is much inclined toward ethylene, thus being short of flexibility of the product. The practice of the present invention ensures a lowering of heat energy per unit product and a diversity of components obtained as products. Thus, heavy hydrocarbons can be effectively utilized as starting materials.

The process of the invention is described in detail by way of embodiment.

The sole FIGURE shows one embodiment of the invention where the industrial application of the process of the invention is illustrated but should not be construed as limiting the present invention thereto.

In the FIGURE, a fuel hydrocarbon (1) is pressurized to a predetermined level and fed to a burning zone (2). In the burning zone (2) is fed preheated oxygen (4) from an oxygen generator (3), followed by burning the fuel hydrocarbon (1) in the presence of steam fed from line (5) to give a hot combustion gas stream (6) of from 1,300° to 3,000° C. The steam may be fed singly or in the form of a mixture with the oxygen (4) and the fuel (1), or may be fed along walls of the burning zone (2) in order to protect the walls and suppress coking.

The hot combustion gas stream (6) from the burning zone (2) is passed into a reaction zone (8). To the reaction zone (8) is fed a heavy virgin hydrocarbon (7) chiefly comprising hydrocarbon components with boiling points not lower than 350° C. in which it directly contacts and mixes with the hot combustion gas stream (6), and is rapidly heated and cracked. As a result, there is produced a hot reaction fluid (9) comprising a major proportion of olefins and particularly ethylene.

Subsequently, the hot reaction fluid (9) is brought to contact with a high boiling cracked oil (boiling point: 200° to 530° C.) (10), cracked gasoline ($C_5$-200° C.) (11), a light paraffin gas (12) including ethane, propane, butane and the like, and a light virgin hydrocarbon (13) having a boiling point not higher than 350° C., which are successively fed to the reaction zone (8), thereby thermally cracking the hydrocarbons therewith. At the same time, the hot reaction fluid (9) is gradually cooled and the heat energy initially thrown into the burning zone (2) is utilized as the heat of reaction for thermally cracking the hydrocarbons.

Next, reaction fluid (14) from the reaction zone (8) is charged into a quencher (15) in which it is quenched and heat is recovered. The quencher (15) is, for example, an indirect quenching heat exchanger in which two fluids passed through inner and outer tubes are heat exchanged. Reaction fluid (16) discharged from the quencher (15) is then passed into a gasoline distillation tower (17) where it is separated into a mixture (21) of cracked gas and steam and a cracked residue (19) (200° C.+). The separated cracked oil (19) is separated, in a distillation apparatus (32), into high boiling cracked oil (10) and a fuel oil (530° C.+). The high boiling cracked oil (10) is recycled downstream of the position where the heavy virgin hydrocarbon (7) is fed and again cracked. On the other hand, the fuel oil (20) is used as a heat source such as process stream, or as the fuel (1) fed to the burning zone (2).

The mixture (21) of cracked gas and stream is passed into a high temperature separation system (22) where it is separated into cracked gas (26), process water (23), BTX (24), and cracked gasoline (25) obtained after separation of the BTX.

The cracked gas (26) is passed into an acid gas separator (27) in which $CO_2$ and $H_2S$ (34) are removed, followed by charging through line (28) into a production separation and purification apparatus (29). In the apparatus (29), the gas (26) is separated into hydrogen and methane (30), olefins (18) such as ethylene, propylene, butadiene and the like, light paraffin gases (12) such as ethane, propane, butane and the like, and $C_5$ and heavier components (31). Of these, the hydrogen and methane (30) may be withdrawn as product (33) of fuel (1), or may be fed to either the feed position of the heavy hydrocarbon (7) at an upper portion of the reaction zone (8) or an upper portion of the feed position. The light paraffin gases (12) are fed to a zone of an intermediate temperature ranging from 850° to 1000° C. in order to obtain ethylene, propylene and the like in high yields, or fed to the zone along with hydrogen and methane to yield hydrogen to a heavy hydrocarbon. The heavy component (31) is recycled, after separation of BTX (24), from line (11) to a position intermediate between the feed positions of the high boiling cracked oil (10) and the light hydrocarbon (13) along with the cracked gasoline (25) from the high temperature separation system (22) and is further cracked.

The fuel hydrocarbon (1) is not limited to any specific ones. Aside from the cracked residue, there are used a wide variety of materials including light hydrocarbons such as light hydrocarbon gases, naphtha, kerosine and the like, heavy hydrocarbons such as topped crude, vacuum residue, heavy oil, shale oil, bitumen, coal-liquefied oil, coal, and the like, various cracked oils, non-hydrocarbons such as CO and $H_2$, and the like. These materials are properly used depending on the process. Fundamentally, materials which are relatively difficult in conversion into valuable products and are low in value are preferentially used as fuel.

Examples of the heavy virgin hydrocarbon (7) which is predominantly of hydrocarbons having boiling points not lower than 350° C. are petroleum hydrocarbons such as vacuum gas oil, topped crude, vacuum residue and the like, shale oil, bitumen, coal-liquefied oil, coal and the like, but are not limited thereto. Examples of the light hydrocarbon (13) are LPG, naphtha, kerosine, gas oil, paraffinic crude oil, paraffinic topped crude and the like.

The feed position where the cracked oil is recycled is finally determined in view of the type of starting virgin hydrocarbon, the properties of the cracked oil, and the composition of final product. For instance, when topped crude is used as the starting heavy hydrocarbon (7), it is preferable that the high boiling cracked oil (10) is fed at a position upstream of the heavy virgin hydrocarbon (7). On the other hand, when vacuum residue is used as the heavy virgin hydrocarbon (7), it is perferable to feed the cracked oil at a position downstream of the heavy hydrocarbon (7).

The high boiling cracked oil may be further separated, for example, into a fraction of 200° to 350° C. and a fraction of 350° to 530° C., after which they are fed.

In the FIGURE, there are used as starting materials a heavy hydrocarbon mainly composed of hydrocarbon components whose boiling points are not lower than 350° C. and a light hydrocarbon mainly composed of hydrocarbon components whose boiling points are not higher than 350° C. However, as described hereinbefore, instead of the heavy hydrocarbon comprising components having boiling points not lower than 350° C., there may be fed, for example, naphtha alone as the starting material. In the case, the feed of the heavy virgin hydrocarbon (7) is omitted with similar effects being shown. Naphtha may be fed instead of the starting heavy virgin hydrocarbon (7) and the cracked oil may be recycled at an upstream position.

As described in detail, the present invention has a number of features as will not be experienced in prior art techniques. More particularly, a hydrocarbon is burnt with oxygen in the presence of steam and the resulting hot gas is fed to a reactor as a heat source necessary for the reaction. To the reactor is first fed a heavy hydrocarbon comprising hydrocarbons having boiling points not lower than 350° C. by which it is thermally cracked. Downstream of the feed is further fed a light hydrocarbon comprising hydrocarbon components whose boiling points are not higher than 350° C., thereby thermally cracking the light hydrocarbon. The above fact brings about the following good effects.

(1) Arbitrary heavy hydrocarbons, arbitrary light hydrocarbons and cracked oils thereof can be thermally cracked under optimum conditions determined from cracking characteristics thereof. As a result, there can be obtained ethylene, propylene, $C_4$ fractions and BTX in arbitrary ratios while achieving high gasification rates and high yields.

(2) Even produced cracked oils and cracked gases other than olefins can be cracked under cracking conditions which are optimized in view of the properties thereof, thus being effectively utilized. Consequently, cracked oil which has been utilized only as fuel may be converted into BTX, olefins and the like useful components.

(3) For the thermal cracking of heavy hydrocarbons, it is necessary to effect the cracking under high severity conditions of high temperature and short residence time in order to increase a gasification rate to a maximum. As a result, a high yield of olefins can be expected. On the other hand, however, there is the problem that the energy cost per unit product increases and a ratio in yield of ethylene to the total olefins becomes high. According to the invention, the energy fed to the high temperature cracking zone is effectively utilized as a heat of reaction of a light hydrocarbon being cracked in a subsequent step.

This contributes to increase the flexibility of the composition of product as a whole with the energy cost per unit product being reduced considerably.

(4) The utility such as fuel, oxygen and the like per unit product is remarkably reduced, with the result that the consumption of combustion gas lowers considerably and thus the separation and purification cost for cracked gas can also be reduced noticeably.

(5) Hydrogen and methane produced by thermal cracking of light hydrocarbons serve to stabilize radicals produced by thermal cracking heavy hydrocarbons at the upstream zone, thereby suppressing formation of sludge and coking in the reactor and the quenching heat exchanger. By the synergistic effect of diluting coking substances with the cracked gas from the light hydrocarbon, heat recovery by an indirect quenching heat exchanger becomes easy.

(6) By the cracking of light hydrocarbons which are ready to crack, the upstream hot gas can be effectively quenched.

(7) Hydrogen and methane which are ordinarily used as fuel are utilized in thermal cracking of heavy hydrocarbons in the practice of the invention, by which hydrogen deficient in heavy hydrocarbon is supplemented, with an increase of the gasification rate of and the yield of olefins from heavy hydrocarbons.

The present invention is described in more detail by way of examples, which should not be construed as limiting the present invention but for explanation only.

EXAMPLE I

A vacuum residue (specific gravity 1.02, S content 4.3%, pour point 40° C.) from the Middle East crude oil was used as fuel. The vacuum residue was charged into a combustor provided above a reactor where it was burnt with oxygen while blowing steam preheated to over 500° C. from all directions, thereby generating a hot gas comprising steam. The hot gas was introduced into the reactor beneath the combustor where it was uniformly mixed with a starting hydrocarbon which was fed a plurality of burner mounted on the side walls of the reactor, thereby thermally cracking the starting hydrocarbon. Thereafter, the reaction product was indirectly cooled with water from outside, followed by analyzing the product to determine a composition thereof. On the side walls of the reaction were provided a number of nozzles along the direction of flow of the reaction fluid in order to set different cracking conditions for different starting hydrocarbons. By this, it was possible to make a test in which different types of starting hydrocarbons or cracked oils were fed to different positions of the reactor.

The residence time was calculated from the capacity of the reactor and the reaction conditions.

Table 1 shows the results of the test concerning the relation between cracking conditions and yields of products in which the Middle East naphtha (boiling point 40°–180° C.) was cracked at a pressure of 10 bars.

TABLE 1

| | Comparative Example 1 | Comparative Example 2 | Example 1 |
|---|---|---|---|
| Feed (kg/kg of starting naphtha) | | | |
| (1) fuel | | 0.158 | 0.160 |
| (2) steam | 0.5 | 1.8 | 1.8 |
| Cracking Conditions | | | |
| (1) pressure (bars) | normal pressure | 10 | 10 |
| (2) residence time (total) (msec.) | 300 | 70 | 80 |
| Yields of Products (kg/kg of starting naphtha) | | | |
| $CH_4$ | 0.141 | 0.107 | 0.118 |
| $C_2H_4$ | 0.307 | 0.262 | 0.301 |
| $C_2H_6$ | 0.030 | 0.033 | 0.033 |
| $C_3H_6$ | 0.130 | 0.161 | 0.159 |
| $C_4$'S | 0.080 | 0.126 | 0.128 |
| BTX | 0.120 | 0.149 | 0.153 |
| cracked gasoline*1 | 0.097 | 0.026 | 0.025 |
| cracked residue*2 | 0.060 | 0.114 | 0.061 |

*1 $C_5$ - 200° C. fractions (exclusive of BTX)
*2 200° C.+ fractions.

In Comparative Example 1 of Table 1, there are shown yields ordinarily attained when naphtha is cracked by a hitherto employed tubular-type cracking furnace. In Comparative Example 2 and Example 1, there are shown results of the cracking procedure using the reaction system of the invention in which cracked gasoline obtained by cracking of naphtha is recycled to the reactor in order to crack it along with starting naphtha. In Comparative Example 2, the cracked gasoline and cracked residue were recycled to substantially the same position as the feed position of the starting naphtha, whereas, in Example 1, the cracked residue, cracked gasoline and naphtha were fed in this order at different positions and cracked. The amounts of recycled cracked gasoline and cracked residue were, respectively, 0.148 kg/kg of starting naphtha and 0.044 kg/kg of starting naphtha. The temperature at the outlet of the reactor was from 750° to 800° C. in both Comparative Example 2 and Example 1. The cracking temperatures of the cracked residue and cracked gasoline in Example 1 were, respectively, about 1,400° C. and about 1,300° C. The residence time for both cracked reside and cracked gasoline after the feed to the reactor before a subsequent feed of the hydrocarbon was about 5 milliseconds.

As will be clear from the results of Example 1, the cracking of the cracked oil and cracked gasoline under more severe conditions than the case of starting naphtha results in a higher yield of ethylene and a high gasification rate than the cracking of Comparative Example 2 where the cracked residue and cracked gasoline are cracked under the same conditions as starting naphtha. The yields of $C_3$ and $C_4$ components are maintained substantially at the same levels. Upon comparing the results of Example 1 with those of Comparative Example 1, it will be seen that formation of $CH_4$ is suppressed with an increase in yield of $C_3$, $C_4$ components and BTX. As a whole, the gasification rate is significantly improved. In case where cracked materials are recycled and cracked under the same cracking conditions as starting naphtha (Comparative Example 2), the cracked gasoline tends to be converted into heavy cracked residue which are more difficult to handle.

EXAMPLE II

Table 2 shows the results of a test in which the same vacuum residue as used in Example 1 as fuel was provided as a heavy hydrocarbon and naphtha same as used in Example I was provided as a light hydrocarbon. These starting materials were thermally cracked in the same apparatus as in Example 1.

TABLE 2

| | Comparative Example 3 | Example 2 | Example 3 |
|---|---|---|---|
| Feed (kg/kg of starting vacuum residue) | | | |
| (1) fuel | 0.205 | 0.205 | 0.254 |
| (2) steam | 2.2 | 1.3 | 2.2 |
| (3) naphtha | — | 0.72 | 0.72 |
| (4) cracked gasoline | — | | 0.137 |
| (5) high boiling cracked oil | — | | 0.150 |
| Cracking Conditions | | | |
| (1) pressure (bars) | 10 | 10 | 10 |
| (2) residence time (total) (msec.) | 15 | 85 | 90 |
| Yields of Products (kg/kg of starting vacuum residue) | | | |
| $CH_4$ | 0.105 | 0.191 | 0.201 |
| $C_2H_4$ | 0.152 | 0.361 | 0.403 |
| $C_2H_6$ | 0.027 | 0.050 | 0.051 |
| $C_3H_6$ | 0.079 | 0.175 | 0.174 |
| $C_4$·S | 0.033 | 0.126 | 0.121 |
| BTX | 0.047 | 0.123 | 0.180 |
| cracked gasoline*1 | 0.032 | 0.137 | 0.073 |
| cracked residue*2 | 0.495 | 0.519 | 0.479 |

*1 $C_5$ - 200° C. fractions (exclusive of BTX)
*2 200° C.+ fractions.

In Comparative Example 3 of Table 2, there are shown results of a test in which the vacuum residue alone was thermally cracked at an initial temperature of about 1,150° C. The temperature at the outlet of the reactor was as high as 1,060 to 1,070, so that water was directly injected into the reactor for quenching and the reaction product was analyzed to determine its composition. In Example 2, instead of injecting water, naphtha was fed and cracked such that cracking conditions were substantially same as the conditions of Example 1, with the results shown in the table. As will be seen, the hot gas after the thermal cracking of the vacuum residue can be utilized to thermally crack naphtha in amounts as large as the amount of the starting vacuum residue, thus enabling one to improve the composition of a product to a great extent. On the other hand, when the vacuum residue was cracked singly at an initial temperature of 950° C., its gasification rate was about 30 wt% which was much lower than about 50 wt% attained by the high temperature cracking of Comparative Example 3. The above results reveal that the high gasification rate of heavy hydrocarbons needs cracking at high temperatures over 1,000° C. Accordingly, the gas after the cracking of the heavy hydrocarbon is kept at fairly high temperatures, which are sufficient to readily crack light hydrocarbons such as naphtha. As a result, the total yield of products in relation to an amount of fuel increases remarkably as compared with the case of Comparative Example 3. The steam/starting hydrocarbon ratio (kg/kg) lowers from 2.2 of Comparative Example 3 to 1.3 of Example 2. In Example 3, the cracked residue obtained in Example 2 is separated by distillation, followed by feeding the resulting fraction below 530° C. as the high boiling cracked oil to a position corresponding to about 10 milliseconds after the feed of the starting vacuum residue, then cracked gasoline to a position corresponding to further about 5 milliseconds, and finally naphtha to a position corresponding to still further about 5 milliseconds. It will be noted that the fractions of the cracked residue having boiling points over 530° C. are used as fuel instead of the vacuum residue. The high boiling cracked oil was cracked at about 1,080° C. and the cracked gasoline was at about 1,050° C. The cracking conditions of naphtha were substantially same as used in Example 1. The recycle of the cracked gasoline and the high boiling cracked oil is found to contribute to a further increase in yield of ethylene and BTX.

As described in detail above, the process of the invention is defined as follows.

Hydrocarbons being fed to a reactor may be selected from a wide variety of hydrocarbons including light to heavy hydrocarbons and should be fed to a reactor of at least two or larger stages. Especially, where a heavy hydrocarbon comprising components whose boiling points not lower than 350° C. is used, it is preferable that an initial cracking temperature is over 1,000° C. When the initial cracking temperature lower than 1,000° C. is applied to such a heavy hydrocarbon, the gasification rate considerably lowers with an increase in amount of heavy cracked residue. Thus, the merit of the use of heavy hydrocarbons as starting materials is substantially lost. The temperature at the outlet of the reactor should preferably be over 650° C. Lower temperatures involve a considerable lowering of the speed of cracking into gaseous component and permit coking to proceed, making it difficult to attain a high gasification rate.

The residence time is sufficient to be shorter for a starting material being fed at a higher temperature zone. Where starting heavy hydrocarbons are cracked at temperatures over 1,000° C., the residence time is preferably from 5 to 20 milliseconds. The cracking reaction under such reaction conditions as described above is substantially complete within 20 milliseconds. Longer reaction times will lower the yield of olefins by cracking and the effective amount of heat energy by heat loss. On the other hand, reaction times shorter than 5 milliseconds result in unsatisfactory rate of gasification. However, where the inlet temperature is extremely high and a relatively small amount of cracked oil is treated, cracking proceeds satisfactorily within a residence time below 5 milliseconds.

The residence time required for thermal cracking of light hydrocarbons in a downstream reaction zone is preferably from 5 to 1,000 milliseconds. The reaction time shorter than 5 milliseconds results in unsatisfactory yield, whereas longer times bring about a lowering of yield by excessive cracking of once formed olefins. The optimum residence time is determined in view of the types of starting materials, the temperature, the pressure and and the composition of final product. Preferably, a shorter residence time within the above defined range should be used when cracking is effected under higher temperature and higher pressure conditions.

The reaction pressure is determined in view of the types of starting materials, the reaction conditions, and the conditions of cracked gases being treated downstream of the reactor. Higher temperatures result in a larger amount of acetylene. Formation of acetylene is the endothermic reaction which requires a larger amount of heat than in the case of formation of more useful ethylene, thus bringing about an increase in amount of heat per unit amount of desired ethylenic olefin product. In order to suppress the formation of acetylene, it is necessary to increase the reaction pressure. However, an increase of the reaction pressure invites an increase of partial pressure of hydrocarbons, thus accelerating coking. In this sense, it is necessary that coking be suppressed while shortening the residence time as well as increasing the reaction pressure. The reaction pressure has relation with treating conditions of cracked gas. When the process of the invention is operated as an ordinary olefin production plant, the pressure of the separation and purification system ranging from 30 to 40 kg/cm$^2$g should be taken into account. The reaction pressure should be determined in view of the types of starting materials and the cracking conditions. In case where partial combustion is effected in the combustion zone to obtain synthetic gas as well, the reaction pressure should be determined in consideration of applications of the synthetic gas. In the olefin production plant, the pressure is preferably below 50 kg/cm$^2$g, and in the case where synthetic gas is also produced, it is preferable to crack at a pressure below 100 kg/cm$^2$g in view of conditions of preparing methanol which is one of main applications of the synthetic gas. If the reaction pressure is below 2 kg/cm$^2$g, formation of acetylene in the high temperature cracking zone becomes pronounced. Preferably, the pressure is above 2 kg/cm$^2$g.

What is claimed is:

1. A thermal cracking process for selectively producing olefins and aromatic hydrocarbons which comprises the steps of:

(a) burning a hydrocarbon with oxygen in the presence of steam to give a hot gas of from 1300° to 3000° C. comprising steam;

(b) feeding the hot gas to a reaction zone to create higher and lower temperature sections in the reaction zone;

(c) feeding a starting heavy hydrocarbon comprising hydrocarbon components having boiling points above 350° C. to the higher temperature section of the reaction zone under conditions of temperature not lower than 1000° C., a pressure of not higher than 100 kg/cm$^2$g, and for a residence time of 5 to 20 milliseconds to thermally crack said hydrocarbon components;

(d) feeding a light hydrocarbon comprising hydrocarbon components having boiling points lower than 350° C. to the lower temperature section of the reaction zone so as to thermally crack said light hydrocarbon under conditions of temperature at the outlet of the reactor of no lower than 650° C., a pressure not higher 100 kg/cm$^2$g, and a residence time ranging from 5 to 1000 milliseconds; and (e) quenching the resulting product.

2. The thermal cracking process of claim 1 wherein the reaction pressure is from 2 to 100 kg/cm$^2$g.

3. The thermal cracking process of claim 1 wherein light paraffins produced by the thermal cracking are recycled to the lower temperature section of the reaction zone.

4. The thermal cracking process of claim 3 wherein cracked oils produced by the thermal cracking are recycled to the higher temperature section of the reaction zone.

5. The thermal cracking process of claim 4 wherein the components produced by the thermal cracking, which are lighter than cracked oil but heavier than light paraffins, are recycled to a section between the lower and higher temperature sections of the reaction zone.

* * * * *